US005277003A

United States Patent [19]

Myers

[11] Patent Number: 5,277,003

[45] Date of Patent: Jan. 11, 1994

[54] METHOD AND MEANS FOR MAINTAINING A DRY AND RADON-FREE BASEMENT

[76] Inventor: Jeffrey J. Myers, 15 N. High St., Lebanon, Ohio 45036

[21] Appl. No.: 738,284

[22] Filed: Jul. 30, 1991

[51] Int. Cl.[5] ..... E02D 19/00

[52] U.S. Cl. ..... 52/169.5; 52/169.14; 52/741.4

[58] Field of Search ..... 52/169.5, 169.14, 741.4

[56] References Cited

U.S. PATENT DOCUMENTS

| | | | |
|---|---|---|---|
| 3,850,193 | 11/1974 | Gazzo | 52/169.5 |
| 3,852,925 | 12/1974 | Gazzo | 52/169 |
| 4,075,800 | 2/1978 | Molick | 52/169.5 |
| 4,391,071 | 6/1983 | Schantz | 52/169.5 |
| 4,757,651 | 7/1988 | Crites | 52/169.5 |
| 4,798,034 | 1/1989 | Jarnagin | 52/169.5 |
| 4,949,626 | 8/1990 | Townsend | 52/169.5 |

*Primary Examiner*—Henry E. Raduazo
*Attorney, Agent, or Firm*—Zarley, McKee, Thomte, Voorhees & Sease

[57] ABSTRACT

A vacuum system is utilized for preventing radon gas from entering the basement of a home. The gas is drawn from the interior of the basement walls, the exterior of the basement walls and from underneath the floor into a drain tile under the floor where the gas is then evacuated to vent pipes extending to the top of the home where the gas is vented to the atmosphere. A water trap is provided in a pipe extending from a first drain passageway between the basement wall and the exterior edge of the basement floor to the drain tile under the floor preventing radon gases from moving upwardly into the basement. The first drain passageway and floor and wall are sealed against migration of gases upwardly from under the floor.

12 Claims, 2 Drawing Sheets

METHOD AND MEANS FOR MAINTAINING A DRY AND RADON-FREE BASEMENT

BACKGROUND OF THE INVENTION

The problem of a wet basement and how to remedy it has been disclosed in Joseph F. Gazzo U.S. Pat. No. 3,852,925, Dec. 10, 1974. This problem has now been compounded by the identification of the presence of radon gas in many basements. A study conducted by the University of Iowa has shown that 75% of Iowa houses exceed the acceptable level of radon which is 4 picocuries per liter of air. Iowa houses average 9 picocuries per liter.

What is needed then is a system for keeping basements dry and also eliminating radon gas.

SUMMARY OF THE INVENTION

This invention is an improvement on the wet basement prevention system disclosed in the Gazzo patent. The improvement is in the fact that the radon gas is prevented from entering the basement by being evacuated from the interior and exterior of the basement walls and from under the floor by utilizing a modified water drain system.

Radon gas may be present in the ground outside the basement wall, in the wall and below the basement floor. The Gazzo patent teaches providing weep holes at the bottom of hollow block walls for draining the walls of any water that seeps from the outside to the interior. This water is drained into a drainage ditch between the walls and the basement floor which then drains to a tile under the floor which conveys the water away from the home through use of gravity or a sump pump. In solid walls moisture may seep through cracks unto the inside face and follow the wall to the floor where it is received in the drainage ditch and drained away to the tile under the floor.

The radon gas elimination system includes providing a seal between the floor and the wall around a drain passageway between the floor and the wall and then extending a pipe to a drain tile under the floor. A water trap is placed in the pipe to function as a radon gas blockage means to prevent it from passing from the drain tile back into the interior of the home. Water may be added to this water trap as required to maintain it during dry weather as a blockage of radon gas into the home. The gases are evacuated from the drain tile utilizing a chimney system or through the addition of a vacuum-type fan which will vent the gas to the exterior of the home.

It is seen that this system will evacuate radon gas from all areas including the interior of the home, the walls, the exterior ground around the walls and the ground below the floor of the basement.

DESCRIPTION OF THE PREFERRED EMBODIMENT

Figure 1:
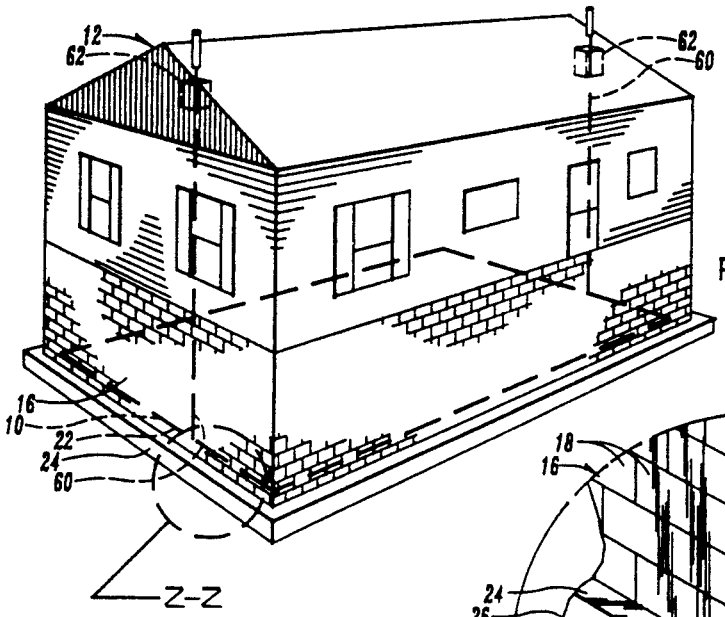
FIG. 1 is a perspective view of a home including the water and radon gas elimination system of this invention.
Figure 2:
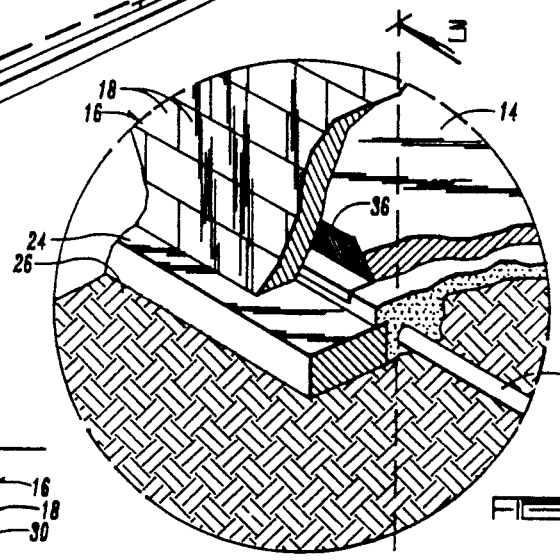
FIG. 2 is an enlarged fragmentary perspective view of the basement wall and floor as indicated by the line 2—2 in FIG. 1.
Figure 3:
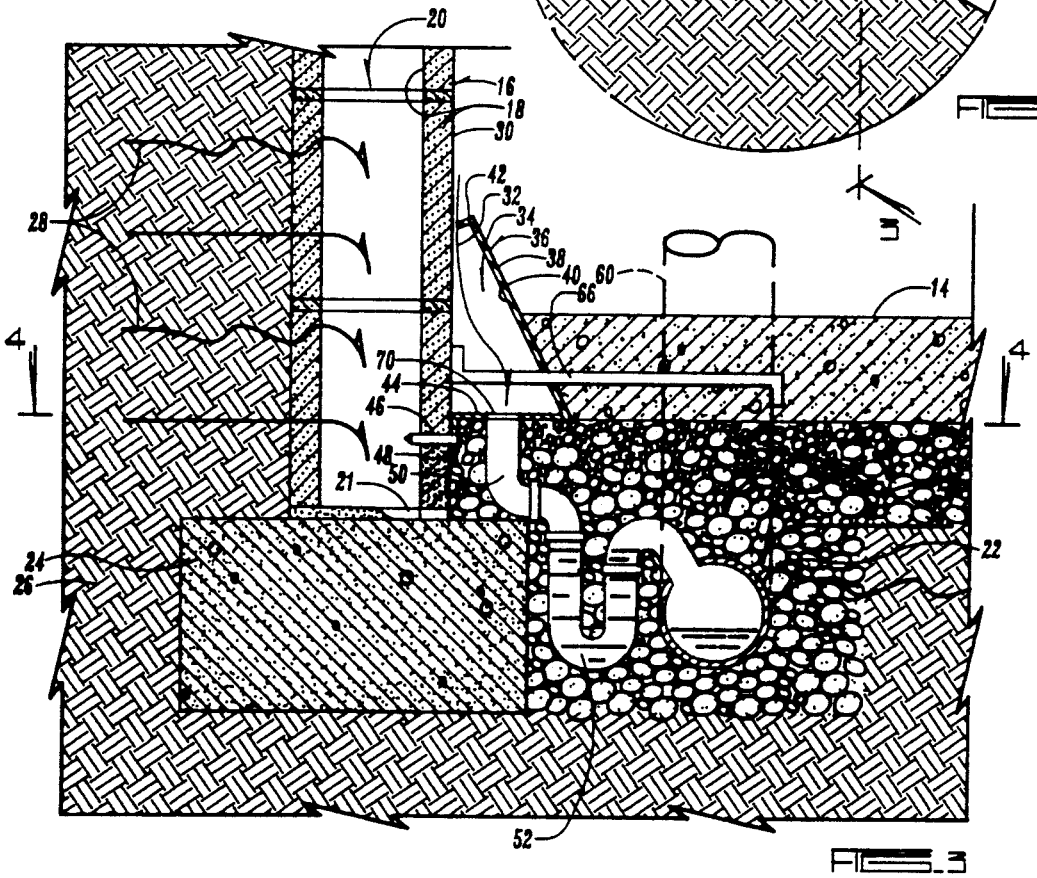
FIG. 3 is an enlarged fragmentary cross-sectional view taken along line 3—3 in FIG. 2.
Figure 4:
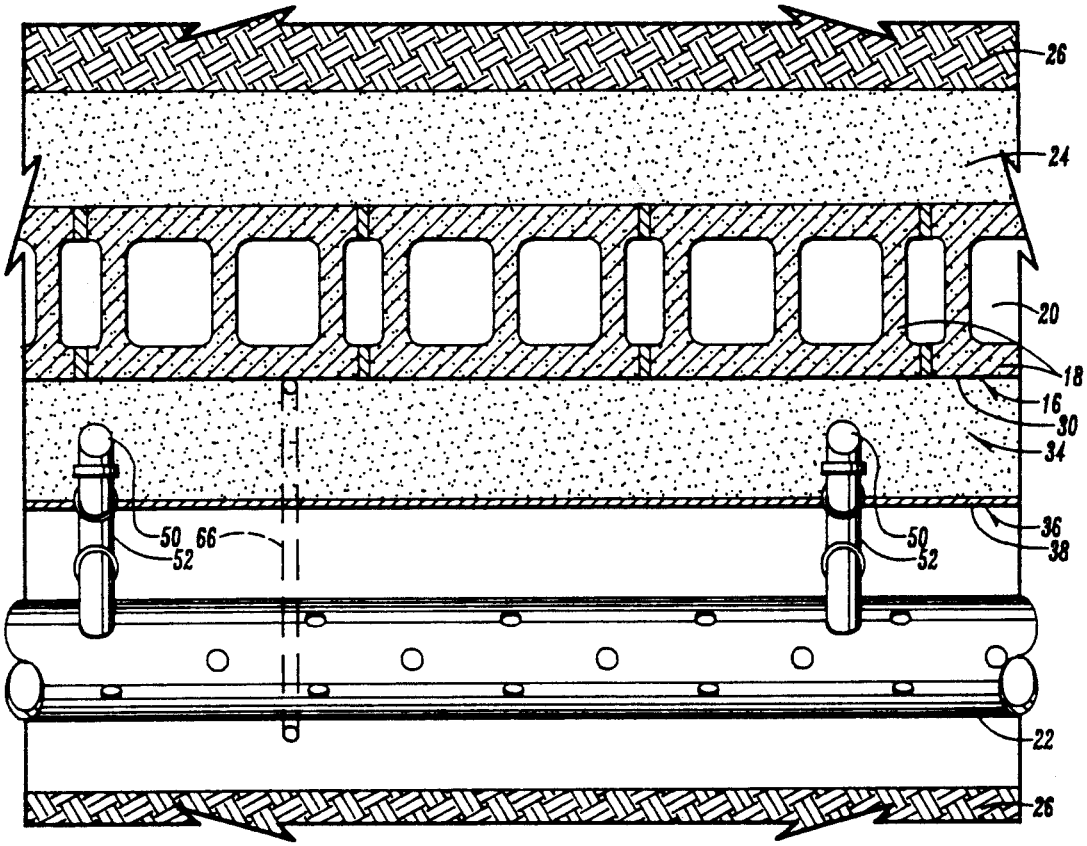
FIG. 4 is fragmentary cross-sectional view taken along line 4—4 in FIG. 3.

The basement water drainage and radon elimination system of this invention is referred to generally in FIG. 1 by the reference numeral 10 and is shown in a house 12 having a basement floor 14 and a basement wall 16. The wall 16 as shown is formed of hollow concrete blocks 18 which define a vertical chamber 20 extending to the bottom where weep holes 21 are provided for draining moisture contained in the chamber 20 to beneath the floor 14 into a bed of rock in which a drain tile 22 extends around the entire perimeter of the floor inwardly from the wall 16. The wall 16 sets upon footings 24 and ground soil 26 exists around the exterior surface of the wall 16. Moisture from the ground 26 may at times leak through the blocks 18 into the chamber 20 as indicated by the arrows 28 in FIG. 3. Moisture may also reach the inside face 30 of the wall 16 and run down the wall as indicated by the arrow 32 where it is drained off ultimately to the tile 22 under the floor. Moisture may seep through poured concrete walls at cracks and joints in the wall.

A first drain passageway 34 is provided between the inside face 30 of wall 16 and the floor 14. The passageway 34 is defined by a channel member 36 having an upstanding wall 38 which extends closely adjacent the inside face 30 of the wall 16 and terminates in an inwardly extending edge 40 positioned closely adjacent the inside face 30. Space is left for water to flow along the inside face 30. The bottom end of the upstanding wall 38 includes an inwardly extending horizontal wall 44 which is fastened to the inside face 30 of the wall 16 by fasteners 46 extending through a downwardly extending flange 48.

A second drain passageway 50 in the form of a pipe extends from the horizontal wall 44 of the channel member 36 to the water and radon drain conduit 22. A water trap 52 is provided in the pipe 50 and functions as a radon gas blockage means for preventing gas from moving upwardly into the first drain passageway 34 and the interior of the home. Should conditions warrant, additional water could be added to the trap 52 to maintain the radon gas blockage function.

Vent pipe 60 extends from the water and radon drain conduit 22 at opposite ends of the home to the top of the house for exhausting the radon gas to the atmosphere. A chimney-type circulation of air may be induced to evacuate the radon gas or vacuum fans 62 may be added to draw the gas upwardly for venting to the atmosphere.

Since the basement floor does not abut against the basement wall 16 due to the drain passageway 34 therebetween, a series of braces 66 in the floor 14 press against the wall 16 to keep it from being pushed inwardly by the outside water in the ground 26.

An alternative to the water trap 52 would be a one-way valve (not shown) placed in the outlet 70 in the horizontal wall 44 of the channel member 36. Water could flow downwardly but water and gas cannot flow upwardly into the home.

It is seen that through the utilization of the water drainage and radon elimination system of this invention that it should be possible to maintain a dry basement, free of dangerous radon gases.

I claim:

1. A basement drainage and radon elimination system comprising, a basement including a wall having interior and exterior sides extending along a floor and defining a first drain passageway between said wall and floor which is open upwardly to receive water which may pass through said wall from the exterior to the interior sides and run down the wall into said first drain passageway, a water and radon drain conduit under said floor, a second drain passageway extending between said first drain passageway and said drain conduit, blockage means in said second drain passageway for substantially blocking radon from moving from said second drain passageway to said first passageway, said floor having interior and exterior sides and seal means being provided between said floor, wall and first drain passageway to insulate said interior sides of said floor and wall from water and radon, and a radon evacuation means being connected to said water and drain conduit and being in communication with the exterior of said basement.

2. The structure of claim 1 wherein said second drain passageway is a pipe.

3. The structure of claim 2 wherein said blockage means is further defined as being a water filled trap.

4. The structure of claim 1 wherein said first drain passageway is defined by a channel member forming said first drain passageway.

5. The structure of claim 4 wherein said channel member includes an upstanding wall extending along said floor and to closely adjacent said wall at the upper end of said upstanding wall, and a horizontal wall extending from said upstanding wall and said floor into sealing engagement with said basement wall.

6. The structure of claim 5 wherein said pipe has upper and lower ends and is sealingly connected to said horizontal wall at its upper end.

7. The structure of claim 1 wherein said evacuation means is further defined as being a pipe having a fan for producing a vacuum for drawing radon from the interior and exterior of said basement wall under said floor and said drain conduit.

8. The structure of claim 1 wherein said wall includes an interior chamber and drain means adjacent said floor communicates with said drain conduit to relieve said chamber of water and radon.

9. The structure of claim 8 and said drain means is located below said seal means whereby said basement is sealed off from radon in the wall.

10. The method of making basements dry and free of radon gas comprising the steps of, providing a wall having inner and exterior sides extending along a floor and defining a first drain passageway between the inner side of said wall and the floor, providing a water and radon drain conduit under the basement floor, providing a second drain passageway between said first drain passageway and said drain conduit, providing blockage means in said second passageway for substantially blocking radon from moving from said second drain passageway to said first passageway, substantially sealing said wall, said floor and said first drain passageway from leaking radon from under the floor to the interior side of said wall and floor, and providing a radon evacuation means communicating between said radon and water drain conduit and the exterior side of said wall.

11. The method of claim 10 wherein the step of providing blockage means in said second passageway is further defined as providing a water trap in said second passageway and providing a pipe as said second passageway between said first drain passageway and said water and radon drain conduit.

12. The method of claim 11 and the step cf adding water to said water trap as needed for it to block radon gas movement through said pipe.

* * * * *